US010041158B2

(12) United States Patent
Tanaka et al.

(10) Patent No.: US 10,041,158 B2
(45) Date of Patent: Aug. 7, 2018

(54) MULTI-PHASE HOT-ROLLED STEEL SHEET HAVING IMPROVED DYNAMIC STRENGTH AND A METHOD FOR ITS MANUFACTURE

(75) Inventors: Yasuaki Tanaka, Nishinomiya (JP); Toshiro Tomida, Kobe (JP); Kaori Kawano, Neyagawa (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 855 days.

(21) Appl. No.: 13/643,696

(22) PCT Filed: Apr. 7, 2011

(86) PCT No.: PCT/JP2011/058816
§ 371 (c)(1),
(2), (4) Date: Jan. 7, 2013

(87) PCT Pub. No.: WO2011/135997
PCT Pub. Date: Nov. 3, 2011

(65) Prior Publication Data

US 2013/0098515 A1 Apr. 25, 2013

(30) Foreign Application Priority Data

Apr. 28, 2010 (WO) ..... PCT/JP2010/057588

(51) Int. Cl.
*C22C 38/58* (2006.01)
*C22C 38/00* (2006.01)
(Continued)

(52) U.S. Cl.
CPC ..... *C22C 38/58* (2013.01); *C21D 6/005* (2013.01); *C21D 8/02* (2013.01); *C21D 8/0226* (2013.01);
(Continued)

(58) Field of Classification Search
CPC ..... C21D 2211/002; C22C 38/18
(Continued)

(56) References Cited

U.S. PATENT DOCUMENTS 7,252,724 B2 * 8/2007 Tosaka ..... C21D 8/0226 148/651
2003/0084966 A1 * 5/2003 Ikeda et al. ..... 148/320
(Continued)

FOREIGN PATENT DOCUMENTS

EP 1 398 390 3/2004
EP 1 918 403 5/2008
(Continued)

*Primary Examiner* — Colleen P Dunn
*Assistant Examiner* — Jeremy C Jones
(74) *Attorney, Agent, or Firm* — Clark & Brody

(57) ABSTRACT

A multi-phase hot-rolled steel sheet having improved strength in an intermediate strain rate region has a chemical composition comprising, in mass percent, C: 0.07-0.2%, Si+Al: 0.3-1.5%, Mn: 1.0-3.0%, P: at most 0.02%, S: at most 0.005%, Cr: 0.1-0.5%, N: 0.001-0.008%, at least one of Ti: 0.002-0.05% and Nb: 0.002-0.05%, and a remainder of Fe and impurities. The area fraction of ferrite is 7-35%, the grain diameter of ferrite is in the range of 0.5-3.0 μm, and the nanohardness of ferrite is in the range of 3.5-4.5 GPa. A second phase which is the remainder other than ferrite contains martensite and bainitic ferrite and/or bainite. The average nanohardness of the second phase is 5-12 GPa, and the second phase contains a high-hardness phase of 8-12 GPa with an area fraction of 5-35% based on the overall structure.

6 Claims, 1 Drawing Sheet

(51) Int. Cl.

| | |
|---|---|
| ***C22C 38/38*** | (2006.01) |
| ***C22C 38/04*** | (2006.01) |
| ***C22C 38/28*** | (2006.01) |
| ***C22C 38/02*** | (2006.01) |
| ***C21D 8/02*** | (2006.01) |
| ***C21D 6/00*** | (2006.01) |
| ***C21D 9/46*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/40*** | (2006.01) |
| ***C22C 38/50*** | (2006.01) |

(52) U.S. Cl.

CPC ..... *C21D 9/46* (2013.01); *C22C 38/001* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/28* (2013.01); *C22C 38/38* (2013.01); *C22C 38/40* (2013.01); *C22C 38/50* (2013.01); *C21D 2211/002* (2013.01); *C21D 2211/005* (2013.01); *C21D 2211/008* (2013.01)

(58) Field of Classification Search

USPC ..... 148/645

See application file for complete search history.

(56) References Cited

U.S. PATENT DOCUMENTS

| | | | | |
|---|---|---|---|---|
| 2008/0131305 | A1 | 6/2008 | Okitsu | |
| 2008/0202639 | A1* | 8/2008 | Tomida | B32B 15/012 148/506 |
| 2009/0252641 | A1* | 10/2009 | Hoshi | C22C 38/02 420/118 |
| 2009/0301613 | A1* | 12/2009 | Koo | C22C 38/02 148/537 |
| 2011/0036465 | A1* | 2/2011 | Kawasaki | C21D 8/0205 148/533 |
| 2011/0079328 | A1* | 4/2011 | Yokoi | C21C 7/0006 148/504 |
| 2013/0000798 | A1* | 1/2013 | Sadasue | C21D 1/25 148/645 |

FOREIGN PATENT DOCUMENTS

| | | | |
|---|---|---|---|
| ES | 2256378 | * | 7/2006 |
| JP | 60-243226 | | 12/1985 |
| JP | 62-174322 | | 7/1987 |
| JP | 2000-008136 | | 1/2000 |
| JP | 2000008136 A | * | 1/2000 |
| JP | 2004-084074 | | 3/2004 |
| JP | 2005-305454 | | 11/2005 |
| JP | 2006-161077 | | 6/2006 |
| JP | 3958842 | | 5/2007 |
| JP | 2008-189984 | | 8/2008 |

* cited by examiner

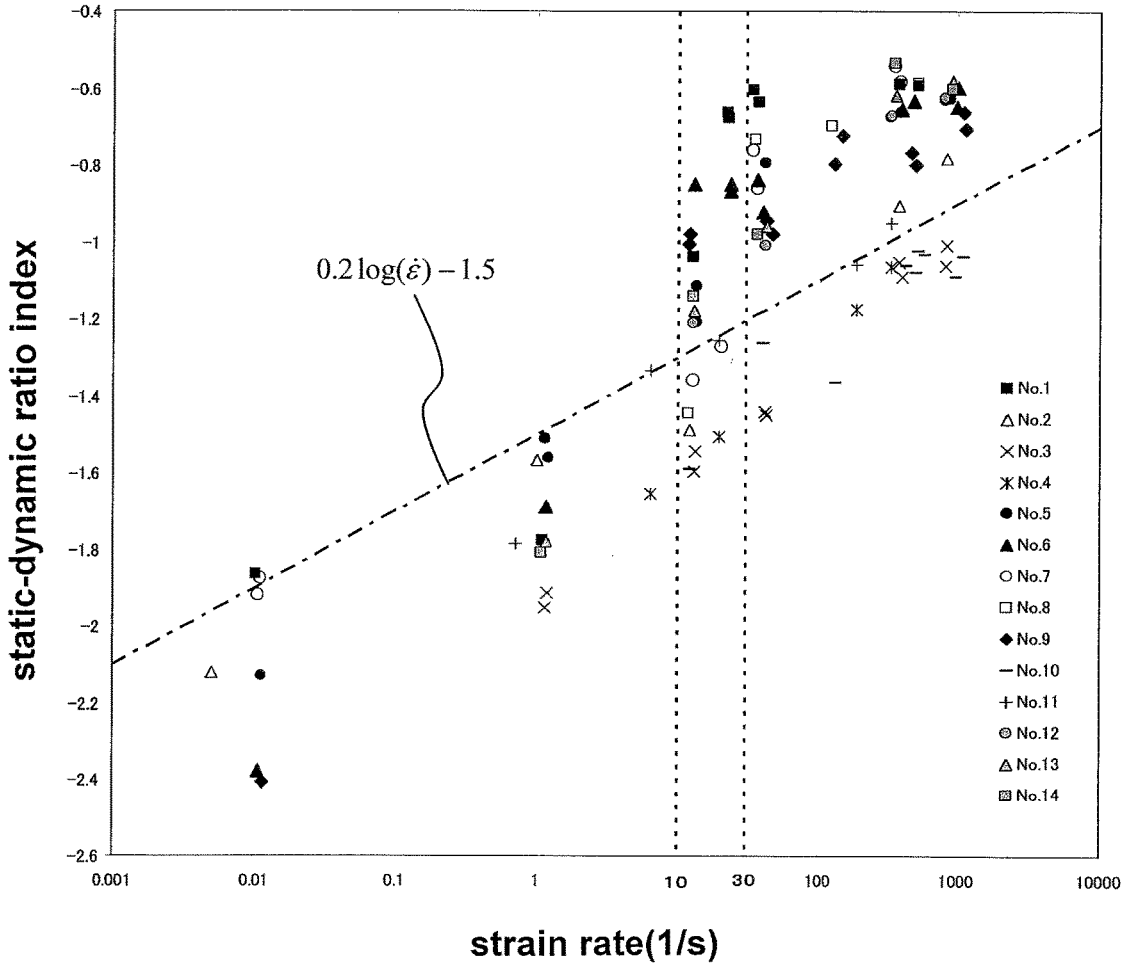
static-dynamic ratio index
strain rate(1/s)
$0.2\log(\dot{\varepsilon})-1.5$
-0.4
-0.6
-0.8
-1
-1.2
-1.4
-1.6
-1.8
-2
-2.2
-2.4
-2.6
0.001
0.01
0.1
1
10
30
100
1000
10000
No.1
No.2
No.3
No.4
No.5
No.6
No.7
No.8
No.9
No.10
No.11
No.12
No.13
No.14

MULTI-PHASE HOT-ROLLED STEEL SHEET HAVING IMPROVED DYNAMIC STRENGTH AND A METHOD FOR ITS MANUFACTURE

TECHNICAL FIELD

This invention relates to a multi-phase hot-rolled steel sheet having improved dynamic strength and particularly improved dynamic strength in a strain rate region of at least 30 $s^{-1}$ to at most 500 $s^{-1}$ (referred to below as strain rate dependence of strength in an intermediate strain rate region) and to a method for its manufacture.

BACKGROUND ART

In recent years, in order to protect the global environment, there have been demands for decreases in the weight of automotive bodies as one way of decreasing the amount of $CO_2$ discharged from automobiles. It is not permissible for decrease in weight to decrease the strength demanded of automotive bodies. Therefore, increases in the strength of steel sheets for automobiles are being promoted.

There are increased demands by society for safety of automobiles in collisions. For this reason, the properties demanded of steel sheets for automobiles are not simply a high strength; there is also a desire for improved impact resistance if a collision should occur during driving. Namely, there is a desire for high resistance to deformation when deformation takes place at a high strain rate. The development of steel sheets which can satisfy these demands is being studied.

In general, it is known that steel sheets made of mild steel have a large difference between the static stress and the dynamic stress (in this invention, this is referred to as the static-dynamic difference) and that the difference decreases as the strength of steel sheets increases. An example of a multi-phase steel sheet which has a large static-dynamic difference while having a high strength is a low-alloy TRIP steel sheet.

As a specific example of such a steel sheet, Patent Document 1 discloses a strain induced transformation-type high-strength steel sheet (TRIP steel sheet) having improved dynamic deformation properties which is obtained by pre-straining a steel sheet having a composition comprising, in mass percent, 0.04-0.15% C, one or both of Si and Al in a total of 0.3-3.0%, and a remainder of Fe and unavoidable impurities and having a multi-phase structure comprising a main phase of ferrite and a second phase which includes at least 3 volume percent of austenite. The pre-straining is carried out by one or both of temper rolling and straightening through a tension leveler such that the amount of plastic deformation T produced by pre-straining satisfies the following Equation (A). The steel sheet before pre-straining has such a property that the ratio V(10)/V(0) which is the ratio of the volume fraction V(10) of the austenite phase after deformation at an equivalent strain of 10% to the initial volume fraction V(0) of the austenite phase is at least 0.3. The steel sheet is characterized in that the difference (σd-σs) between the quasi-static deformation strength as when deformed at a strain rate in the range of $5\times10^{-4}$–$5\times10^{-3}$ ($s^{-1}$) after pre-straining in accordance with Equation (A) below and the dynamic deformation strength σd when deformed at a strain rate in the range of $5\times10^{2}$-$5\times10^{3}$ ($s^{-1}$) after the pre-straining is at least 60 MPa.

$$0.5[\{(V(10)/V(0))/C\}-3]+15\geq T\geq 0.5[\{(V(10)/V(0))/C\}-3] \quad (A)$$

As an example of a multi-phase steel sheet having a second phase which is primarily martensite, Patent Document 2 discloses a high-strength steel sheet having an improved balance of strength and ductility and having a static-dynamic difference of at least 170 MPa. The steel sheet comprises fine ferritic grains in which the average grain diameter ds of nanocrystal grains having a grain diameter of at most 1.2 μm and the average grain diameter dL of microcrystal grains having a grain diameter exceeding 1.2 μm satisfy dL/ds≥3. In that document, the static-dynamic difference is defined as the difference between the static deformation stress obtained at a strain rate of 0.01 $s^{-1}$ and the dynamic deformation stress obtained when carrying out a tensile test at a strain rate of 1000 $s^{-1}$. However, Patent Document 2 does not contain any disclosure concerning the deformation stress in an intermediate strain rate region where the strain rate is greater than 0.01 $s^{-1}$ and less than 1000 $s^{-1}$.

Patent Document 3 discloses a steel sheet having a high static-dynamic ratio having a dual-phase structure of martensite having an average grain diameter of at most 3 μm and ferrite having an average grain diameter of at most 5 μm. In that document, the static-dynamic ratio is defined as the ratio of the static yield stress obtained at a strain rate of $10^{-3}$ $s^{-1}$ to the dynamic yield stress obtained at a strain rate of $10^{3}$ $s^{-1}$. However, there is no disclosure concerning the static-dynamic difference in a range in which the strain rate is greater than 0.01 $s^{-1}$ and less than 1000 $s^{-1}$. In addition, the static yield stress of the steel sheet disclosed in Patent Document 3 is a low value of 31.9 kgf/$mm^2$-34.7 kgf/$mm^2$.

PRIOR ART DOCUMENTS

Patent Documents

Patent Document 1: JP 3958842 B
Patent Document 2: JP 2006-161077 A
Patent Document 3: JP 2004-84074 A

DISCLOSURE OF INVENTION

Prior art steel sheets like those described above have the following problems.

It is difficult for a high-strength multi-phase steel sheet having ferrite as the dominant phase and martensite as a second phase to satisfy both formability and impact absorbing properties.

For use as a collision absorbing member for automobiles, there is a demand for an improvement in the dynamic strength of in a strain rate region of at least 30 $s^{-1}$ to at most 500 $s^{-1}$, namely, for an increase in the strength in an intermediate strain rate region. However, in the prior art, the static-dynamic difference or the static-dynamic ratio have been evaluated by comparing the dynamic stress such as the dynamic yield stress or the dynamic tensile strength obtained at a high strain rate of at least 500 $s^{-1}$ with the static stress determined by the quasi-static yield stress or the tensile strength. This is because in the past no means has been proposed for increasing the strength in an intermediate strain rate region.

The object of the present invention is to provide a multi-phase hot-rolled steel sheet having an improved dynamic strength and particularly an improved dynamic strength in an intermediate strain rate region and a method for its manufacture.

The present inventors carried out various investigations of methods for increasing the dynamic strength and particularly the strength in an intermediate strain rate region of a high-strength multi-phase steel sheet. As a result, they obtained the following knowledge.

(1) In order to increase the strength in an intermediate strain rate region, it is necessary to increase both the static strength and the static-dynamic difference.

(2) Hard martensite is effective at increasing static strength. However, if the area fraction of hard martensite increases, a desired static-dynamic difference is not obtained.

(3) If the area fraction of ferrite is increased, the static-dynamic difference is increased. However, as the area fraction of ferrite increases, the static strength decreases, so a desired dynamic strength is not obtained.

(4) One means for increasing the static strength of ferrite is solid solution strengthening. Ferrite formed at a relatively high temperature allows alloying elements (such as C, Si, Mn, and Cr) to dissolve therein so as to form solid solution, and it is possible to increase the static strength of ferrite itself.

(5) Static strength is increased by refining grains.

(6) Among low temperature transformed phases, bainitic ferrite and bainite are effective at increasing the dynamic strength and the static-dynamic difference.

(7) The static-dynamic difference is further increased by suppressing the formation of carbides in bainitic ferrite or bainite.

(8) The formation of carbides contained in each of bainitic ferrite and bainite is suppressed by addition of minute amounts of Si and Cr.

(9) In a hot rolling process, it is possible to refine ferrite by controlling the time between passes in finish rolling and optimizing the cooling conditions after finish rolling.

Based on the above knowledge, it was found that it is possible to obtain a steel sheet having significantly increased static strength and static-dynamic difference by increasing the static-dynamic difference due to an increased area fraction of ferrite while increasing the static strength due to solid solution strengthening of ferrite and refinement of grains and by having as a second phase not only martensite which can increase the static strength but also bainite and/or bainitic ferrite in which the formation of carbides is suppressed by controlling the chemical composition.

In one embodiment, the present invention, which is provided based on the above knowledge, is a multi-phase hot-rolled steel sheet characterized by having a chemical composition comprising, in mass percent, C: at least 0.07% and at most 0.2%, Si+Al: at least 0.3% and at most 1.5%, Mn: at least 1.0% and at most 3.0%, P: at most 0.02%, S: at most 0.005%, Cr: at least 0.1% and at most 0.5%, N: at least 0.001% and at most 0.008%, one or both of Ti: at least 0.002% and at most 0.05% and Nb: at least 0.002% and at most 0.05%, and a remainder of Fe and impurities, and by having ferrite with an area fraction of at least 7% and at most 35% and a second phase which is the remainder other than ferrite, the ferrite having a grain diameter of at least 0.5 μm and at most 3.0 μm and a nanohardness of at least 3.5 GPa and at most 4.5 GPa, the second phase including martensite and at least one of bainitic ferrite and bainite and having an average nanohardness of at least 5 GPa and at most 12 GPa, the second phase containing a high-hardness phase of at least 8 GPa and at most 12 GPa with an area fraction of at least 5% and at most 35% with respect to the overall structure.

The above-described chemical composition may further contain, in mass percent, one or more elements selected from the group consisting of V: at most 0.2%, Cu: at most 0.2%, Ni: at most 0.2%, and Mo: at most 0.5%.

In another aspect, the present invention is a method of manufacturing a multi-phase hot-rolled steel sheet by continuous hot rolling of a slab having a chemical composition comprising, in mass percent, C: at least 0.07% and at most 0.2%, Si+Al: at least 0.3% and at most 1.5%, Mn: at least 1.0% and at most 3.0%, P: at most 0.02%, S: at most 0.005%, Cr: at least 0.1% and at most 0.5%, N: at least 0.001% and at most 0.008%, one or two of Ti: at least 0.002% and at most 0.05% and Nb: at least 0.002% and at most 0.05%, and a remainder of Fe and impurities to manufacture a hot-rolled steel sheet, the method comprising the following steps:

a finish rolling step in which the slab is rolled in final finish rolling at a temperature of at least 800° C. and at most 900° C. with the length of time between passes being at least 0.15 seconds and at most 2.7 seconds to form a steel sheet;

a first cooling step including cooling the steel sheet obtained by the finish rolling step to a temperature of 700° C. or below within 0.4 seconds at a cooling rate of at least 600° C./sec;

a holding step including holding the steel sheet which passed through the cooling step in a temperature range of at least 570° C. to at most 700° C. for at least 0.4 seconds; and a second cooling step including cooling the steel sheet which passed through the holding step to 430° C. or below at a cooling rate of at least 20° C./sec and at most 120° C./sec.

The chemical composition may further contain one or more elements selected from the group consisting of V: at most 0.2%, Cu: at most 0.2%, Ni: at most 0.2%, and Mo: at most 0.5%.

According to the present invention, it is possible to stably provide a high tensile strength hot-rolled steel sheet having a large static-dynamic difference in a strain rate region of at least 30 $s^{-1}$ to at most 500 $s^{-1}$. The present invention produces extremely useful industrial effects. For example, if the steel sheet is applied to members for automobiles and the like, such products are expected to exhibit a still further improved safety in case of collisions.

BRIEF EXPLANATION OF THE DRAWINGS

FIG. 1 is a graph showing the dependence of the static-dynamic ratio index on the strain rate.

MODES FOR CARRYING OUT THE INVENTION

Below, the present invention will be explained in detail. In this description, unless otherwise specified, percent with respect to the content of elements in the chemical composition of steel means mass percent.

1. Metallurgical Structure (1) Ferrite Content

Ferrite increases the static-dynamic difference. It also increases ductility in multi-phase steel. If the area fraction of ferrite is less than 7%, a desired static-dynamic difference is not obtained. On the other hand, if the area fraction of ferrite exceeds 35%, the static strength decreases. Accordingly, the ferrite content expressed as area fraction is at least 7% and at most 35%. Ferrite is preferably pro-eutectoid ferrite.

Measurement of the area fraction is preferably carried out in the following manner. A hot-rolled steel sheet being measured is cut in the direction parallel to the rolling direction, and a portion of the cut cross section located on the center side at a depth of ¼ of the sheet thickness in the sheet thickness direction from the rolled surface (referred to below as the ¼ sheet thickness portion) is polished by known methods to obtain a sample for evaluation. The resulting sample for evaluation is observed with an SEM (scanning electron microscope) to identify ferrite within a field of view. The total area of the ferrite grains identified in the field of view is divided by the area of the field of view to determine the area fraction of ferrite. In order to guarantee the reliability of the value of the area fraction which is obtained, it is preferable to carry out the same measurement on a plurality of samples for evaluation to determine the area fractions of the samples and calculate the average value of the area fractions, which is taken as the ferrite content of the steel sheet.

(2) Grain Diameter of Ferrite

In order to increase static strength, it is necessary to refine ferrite grains. If the ferrite grain diameter exceeds 3.0 μm. the desired strength is not obtained. Accordingly, the upper limit on the ferrite grain diameter is 3.0 μm. The ferrite grain diameter is preferably as small as possible. However, from a practical standpoint, it is difficult to stably achieve a ferrite grain diameter smaller than 0.5 μm. and doing so on an industrial level is essentially impossible. Accordingly, the lower limit on the ferrite grain diameter is 0.5 μm.

Measurement of the ferrite grain diameter is preferably carried out as follows. A sample for evaluation which is obtained in the above-described manner is observed with an SEM or the like. A plurality of ferrite grains are arbitrarily selected in the field of view, the grain diameter of each of these grains which is the diameter of its equivalent circle is determined, and the average of these values is made the ferrite grain diameter. From the standpoint of guaranteeing the reliability of the value of the resulting ferrite grain diameter (the average diameter of equivalent circles), the number of measurements in one field of view is preferably as large as possible. Preferably, the same measurement is carried out on a plurality of samples for evaluation, a plurality of the average values of equivalent circle diameters is averaged, and the result is made the ferrite grain diameter of the steel sheet.

(3) Nanohardness of Ferrite

From the standpoint of obtaining a high strength, it is necessary to carry out solid solution strengthening of ferrite. In the present invention, the hardness of ferrite is evaluated using the nanoindentation method, and the nanohardness which is obtained when applying a load of 500 μN using a Berkovich indenter is used as an index. If the nanohardness of ferrite is less than 3.5 GPa, a sufficient strength is not obtained. The higher the nanohardess of ferrite the better, but there is a limit on the solubility in solid solution of alloying elements. Therefore, the nanohardness should not exceed 4.5 GPa. Accordingly, the nanohardness of ferrite is at least 3.5 GPa and at most 4.5 GPa.

When measuring the nanohardness by the nanoindentation method, a sample can be prepared in the following manner. A hot-rolled steel sheet to be measured is cut in the direction parallel to the rolling direction. The resulting cut cross section is polished by a known method to remove the damaged surface layer, thereby obtaining a sample for evaluation. Polishing is preferably a combination of mechanical polishing, mechanochemical polishing, and electrolytic polishing.

(4) Phases Other Than Ferrite

The remaining phases other than ferrite, namely, the second phase comprises a hard phase. Typical examples of a hard phase are bainitic ferrite, martensite, austenite, and the like. The second phase of a steel sheet according to the present invention includes martensite and at least one phase selected from bainitic ferrite and bainite (referred to below as bainitic ferrite and/or bainite).

Martensite greatly contributes to increasing static strength. Bainitic ferrite and/or bainite contribute to increasing dynamic strength and the static-dynamic difference. Martensite is harder than either bainitic ferrite or bainite. The average hardness of the second phase is determined by the proportion of these phases. The average nanohardness of the second phase is adjusted utilizing this fact. The average nanohardness of the second phase is at least 5 GPa and at most 12 GPa. If the nanohardness of the second phase is less than 5 GPa, it does not contribute to increasing strength. On the other hand, if it exceeds 12 GPa, the static-dynamic difference decreases.

The main constituent of the second phase is preferably bainitic ferrite and/or bainite. Namely, the area fraction of bainitic ferrite and/or bainite with respect to the second phase as a whole is preferably greater than 50% and more preferably at least 70%. The second phase may further contain retained austenite.

(5) Content and Nanohardness of a High-Hardness Phase

In the second phase which comprises a hard phase, the phase having a relatively high hardness (high-hardness phase) contributes to increasing static strength. In particular, a phase having a nanohardness of at least 8 GPa and at most 12 GPa greatly contributes to increasing static strength. In the present invention, a phase in the second phase having a nanohardness of at least 8 GPa and at most 12 GPa is defined as a high-hardness phase. If the content of this high-hardness phase is less than 5% as expressed by area fraction based on the overall structure, a desired high strength is not obtained. On the other hand, this high-hardness phase decreases the static-dynamic difference, and if its content exceeds 35% as expressed by area fraction based on the overall structure, a desired dynamic strength is not obtained. Accordingly, the content of the high-hardness phase is at least 5% and at most 35% as expressed by area fraction based on the overall structure. In the second phase, a phase having a nanohardness of at least 8 GPa and at most 12 GPa primarily comprises martensite. In the second phase, a phase having a nanohardness greater than 4.5 GPa and less than 8 GPa primarily comprises bainitic ferrite.

2. Chemical Composition of the Steel (1) C: At Least 0.07% and at Most 0.2%

The contents of ferrite, martensite, bainitic ferrite, and bainite are suitably adjusted by controlling the C content to a suitable range. By suitably adjusting the contents of these phases, the static strength and static-dynamic difference of a steel sheet can be maintained in a suitable range. If the C content is less than 0.07%, solid solution strengthening of ferrite becomes inadequate, and bainitic ferrite, martensite, and bainite are not formed. As a result, a desired strength is not obtained. On the other hand, if the C content exceeds 0.2%, there is excessive formation of a high-hardness phase, and the static-dynamic difference decreases. Accordingly, the range for the C content is at least 0.07% to at most 0.2%. The lower limit on the C content is preferably at least 0.10% and more preferably at least 0.12%. The upper limit on the C content is preferably at most 0.18% and more preferably at most 0.16%.

(2) Total of the Si Content and the Al Content: At Least 0.3% and at Most 1.5%

The total of the Si content and the Al content (sometimes referred to in the present invention as Si+Al) affects the amount and hardness of transformed phases which are formed during hot rolling and in the course of cooling after hot rolling. Specifically, Si and Al suppress the formation of carbides contained in bainitic ferrite and/or bainite and increase the static-dynamic difference. Si also has a solid solution strengthening effect. From the above standpoint, Si+Al is at least 0.3%. If these elements are added excessively, the above-described effects reach a limit and the steel ends up being embrittled. Therefore, Si+Al is at most 1.5%. Si+Al is preferably less than 1.0%. The lower limit on the Si content is preferably at least 0.3%, and the upper limit on the Si content is preferably at most 0.7%. The lower limit on the Al content is preferably at least 0.03%, and the upper limit on the Al content is preferably at most 0.7%.

(3) Mn: At Least 1.0% and at Most 3.0%

Mn affects the transformation behavior of steel. Accordingly, by controlling the Mn content, the amount and hardness of transformed phases which are formed during hot rolling and in the course of cooling after hot rolling are controlled. If the Mn content is less than 1.0%, the amounts of a bainitic ferrite phase and a martensite phase which are formed are small, and a desired strength and static-dynamic difference are not obtained. If Mn is added in excess of 3.0%, the amount of a martensite phase becomes excessive, and dynamic strength ends up decreasing. Accordingly, the range of the Mn content is at least 1.0% to at most 3.0%. The lower limit on the Mn content is preferably at least 1.5%. The upper limit on the Mn content is preferably at most 2.5%.

(4) P: At Most 0.02%, S: At Most 0.005%

P and S are present in steel as unavoidable impurities. If the P content and S content are high, brittle fracture may take place under high-velocity deformation. In order to suppress this phenomenon, the P content is limited to at most 0.02% and the S content is limited to at most 0.005%.

(5) Cr: At Least 0.1% and at Most 0.5%

The Cr content affects the amount and hardness of transformed phases which are formed during hot rolling and in the course of cooling after hot rolling. Specifically, Cr is effective at guaranteeing the amount of bainitic ferrite. In addition, it suppresses precipitation of carbides in bainitic ferrite. Furthermore, Cr itself has a solid solution strengthening effect. Therefore, if the Cr content is less than 0.1%, a desired strength is not obtained. On the other hand, if its content exceeds 0.5%, the above-described effect saturates and ferrite transformation is suppressed. Accordingly, the Cr content is at least 0.1% and at most 0.5%.

(6) N: At Least 0.001% and at Most 0.008%

N forms nitrides with Ti and Nb and suppresses grain coarsening. An N content of less than 0.001% results in grain coarsening at the time of slab heating, and the structure after hot rolling becomes coarse. On the other hand, if the N content exceeds 0.008%, coarse nitrides which have an adverse effect on ductility are formed. Accordingly, the N content is at least 0.001% and at most 0.008%.

(7) Ti: At Least 0.002% and at Most 0.05%

Ti forms its nitride and carbide. Similarly, Nb, which is described below, forms its nitride and carbide. Therefore, at least one element selected from Nb and Ti is added. TiN which is formed is effective at preventing grains from coarsening. TiC serves to increase static strength. However, if the Ti content is less than 0.002%, the above-described effects are not obtained. On the other hand, if Ti is contained in excess of 0.05%, coarse nitride grains are formed leading to a decrease in ductility, and a ferrite transformation is suppressed. Accordingly, when Ti is contained, its content is at least 0.002% and at most 0.05%.

(8) Nb: At Least 0.002% and at Most 0.05%

Like Ti, Nb forms its nitride and carbide. In the same manner as Ti nitrides, the resulting Nb nitride is effective at preventing grain coarsening of an austenite phase. Furthermore, Nb carbide contributes to preventing grain coarsening of a ferrite phase and increasing static strength. In addition, solid solution Nb contributes to an increase in static strength. However, if its content is less than 0.002%, the above-described effects are not obtained. If Nb is added in excess of 0.05%, it suppresses transformation of ferrite. Accordingly, when Nb is added, its content is at least 0.002% and at most 0.05%. When Nb is added, the lower limit on the Nb content is preferably at least 0.004%. The upper limit on the Nb content is preferably at most 0.02%.

(9) V: At Most 0.2%

Carbonitrides of V are effective at preventing grain coarsening of an austenite phase in a low temperature austenite region. Carbonitrides of V also contribute to preventing grain coarsening of a ferrite phase. Accordingly, a steel sheet according to the present invention may contain V if necessary. However, if its content is less than 0.01%, the above effects are not stably obtained. On the other hand, if it is added in excess of 0.2%, the amount of precipitates which are formed increases and the static-dynamic difference decreases. Accordingly, when V is added, its content is preferably at least 0.01% and at most 0.2% and more preferably at least 0.02% and at most 0.1%. The lower limit on the V content is to more preferably at least 0.02%. The upper limit on the V content is more preferably at most 0.1%.

(10) Cu: At Most 0.2%

Cu has the effect of further increasing the strength of a steel sheet by precipitation strengthening and solid solution strengthening. Accordingly, a steel sheet according to the present invention may contain Cu if necessary. However, if Cu is added in excess of 0.2%, workability markedly decreases. From the standpoint of stably obtaining the above-described effects, the Cu content is preferably at least 0.02%. Accordingly, when Cu is added, its content should be at most 0.2% and is preferably at least 0.02% and at most 0.2%.

(11) Ni: At Most 0.2%

Ni has the effect of further increasing the strength of a steel sheet by precipitation strengthening and solid solution strengthening. Accordingly, a steel sheet according to the present invention may contain Ni if necessary. However, if Ni is added in excess of 0.2%, workability markedly worsens. From the standpoint of stably obtaining the above-described effects, the Ni content is preferably at least 0.02%. Accordingly, when Ni is added, its content should be at most 0.2% and is preferably at least 0.02% and at most 0.2%.

(12) Mo: At Most 0.5%

Mo precipitates as carbides or nitrides and has the effect of increasing the strength of a steel sheet. These precipitates also have the effect of suppressing coarsening of austenite and ferrite and promoting refinement of ferrite grains. In addition, Mo has the effect of suppressing grain growth when heat treatment is carried out at a high temperature. Accordingly, a steel sheet according to the present invention may contain Mo if necessary. However, if Mo is added in excess of 0.5%, a large amount of coarse carbides or nitrides precipitate in steel in a stage before hot rolling, and this leads to a worsening of the workability of a hot-rolled steel sheet. Furthermore, precipitation of a large amount of carbides or nitrides causes age hardening properties to degrade. From the standpoint of stably obtaining the above effects, the Mo content is preferably at least 0.02%. Accordingly, when Mo is added, its content should be at most 0.5% and preferably at least 0.02% and at most 0.5%.

3. Manufacturing Method

Due to having the above-described metallurgical structure and chemical composition, it is possible to provide a hot-rolled steel sheet according to the present invention with not only a high static strength but also an improved static-dynamic difference over a wide range of strain rates in a stable manner. There are no particular limitations on a method of manufacturing a hot-rolled steel sheet according to the present invention, but a hot-rolled steel sheet according to the present invention can be stably manufactured by utilizing a manufacturing method including a hot rolling step performed under the following rolling conditions.

A manufacturing method according to the present invention has the following steps:

a finish rolling step in which the slab is rolled in final finish rolling at a temperature of at least 800° C. and at most 900° C. with the time of length between passes being at least 0.15 seconds and at most 2.7 seconds to form a steel sheet;

a first cooling step including cooling the steel sheet obtained by the finish rolling step to a temperature of 700° C. or below within 0.4 seconds at a cooling rate of at least 600° C./sec;

a holding step including holding the steel sheet which passed through the cooling step in a temperature range of at least 570° C. to at most 700° C. for at least 0.4 seconds; and a second cooling step including cooling the steel sheet which passed through the holding step to 430° C. or below at a cooling rate of at least 20° C./sec and at most 120° C./sec.

A method of manufacturing a hot-rolled steel sheet according to the present invention makes it possible to obtain a fine grain structure by hot working at the time of multipass rolling in a hot state. A refined grain structure having a ferrite grain diameter of at most 3.0 μm can be obtained by controlling the temperature and the length of time between passes of the final finish rolling in the finish rolling step and by rapid cooling within 0.4 seconds at a cooling rate of at least 600° C./sec in the first cooling step, thereby suppressing recrystallization of austenite.

In the holding step, since holding is carried out in a ferrite transformation temperature region, the deformed austenite formed by the above-described step is transformed into ferrite. The temperature necessary for the transformation into ferrite is 570-700° C., and the required time is at least 0.4 seconds.

Subsequently, by carrying out the second cooling step, the remainder which did not undergo transformation into ferrite is transformed into a multi-phase structure comprising martensite and bainitic ferrite and/or bainite. Specifically, cooling is performed to 430° C. or below at a cooling rate of at least 20° C./sec and at most 120° C./sec. Cooling is preferably performed to 300° C. or below at a cooling rate of at least 50° C./sec and at most 100° C./sec.

4. Mechanical Properties

A hot-rolled steel sheet which is obtained in the above manner has improved dynamic strength properties. Specifically, it has improved dynamic strength properties in a strain rate region having a strain rate of at least 30 $sec^{-1}$. The hot-rolled steel sheet has sometimes improved dynamic strength properties in a strain rate region of at least 10 $sec^{-1}$.

In the present invention, dynamic strength is evaluated from the relationship given by the following Equation (1) between the static-dynamic difference and the strain rate of a steel sheet:

$$\log(\sigma/\sigma_0-1)\geq 0.2\log(\acute{\varepsilon})-1.5 \quad (1)$$

where, $\sigma_0$ is the static tensile strength (MPa), $\sigma$ is the tensile strength (MPa) at the strain rate of interest, and $\acute{\varepsilon}$ is the strain rate ($s^{-1}$).

053—I can't figure out the grammar of this paragraph

Equation (1) is based on the finding that Equation (2), which is a formula for the Cowper-Symonds model which is a typical model of the dependence of material strength on strain rate, can establish a relationship similar to Equation (3) with respect to dynamic tensile strength and static tensile strength. Equation (1) was derived by rearranging Equation (2) as shown in Equation (3) and determining the constants in Equation (3).

$$\sigma_d=\sigma_s\{1+(\acute{\varepsilon}/D)^{1/p}\} \quad (2)$$

where $\sigma_d$ is the dynamic yield stress, $\sigma_s$ is the static yield stress, $\acute{\varepsilon}$ is the strain rate, and D and p are constants characteristic of the material.

$$\log(\sigma_d/\sigma_s-1)=(1/p)\log(\acute{\varepsilon})-(1/p)\log(D) \quad (3)$$

The left side of Equation (1) converts the static-dynamic ratio $\sigma/\sigma_0$ into an index (referred to below as the static-dynamic ratio index). The larger the static-dynamic ratio ($\sigma/\sigma_0$), the larger is the static-dynamic ratio index. In general, the static-dynamic ratio increases as the strain rate increases, and the static-dynamic ratio index increases as the static-dynamic ratio increases. When the relationship between the static-dynamic ratio index and the strain rate was investigated, it was found that in a steel sheet having a high static-dynamic ratio, the rate of increase of the static-dynamic ratio index increases as the strain rate increases.

The present inventors focused on this fact and investigated in detail the relationship between the two. As a result, it was found that a steel sheet which satisfies Equation (1) can be identified as a steel sheet having a high static-dynamic ratio in a strain rate region of at least 30 $s^{-1}$ which corresponds to the case which is assumed for a collision during travel of an automobile, and in some hot-rolled steel sheets, the steel sheets have a high static-dynamic ratio in a low strain rate region including a low strain rate of 10 $s^{-1}$ or above.

Based on this finding, in the present invention, determining whether a hot-rolled steel sheet is one having a large static-dynamic ratio was carried out using Equation (1). Namely, a hot-rolled steel sheet according to the present invention is one which satisfies Equation (1) in a strain rate region of 30 $s^{-1}$ or higher.

EXAMPLES

Experiments were carried out using slabs (35 mm thick, 160-250 mm wide, 70-90 mm long) made from Steels A-J having the chemical compositions shown in Table 1. Steels A-C, E, F, and H-J were steels having a chemical composition in the above-described range for the chemical composition according to the present invention. Steels D and G were steels having chemical compositions outside the above-described range for the chemical composition according to the present invention.

TABLE 1

| Steel type | Chemical composition of slabs (mass %, remainder of Fe and unavoidable impurities) | | | | | | | | | | | | |
|---|---|---|---|---|---|---|---|---|---|---|---|---|---|
| | C | Si | Mn | P | S | Cr | Ti | Nb | V | Al | N | Si + Al | Other |
| A | 0.15 | 0.54 | 2.02 | 0.001 | 0.002 | 0.25 | 0.010 | — | — | 0.035 | 0.0025 | 0.5750 | |
| B | 0.15 | 0.53 | 2.04 | 0.001 | 0.002 | 0.25 | 0.010 | 0.008 | — | 0.033 | 0.0021 | 0.5630 | |
| C | 0.15 | 0.52 | 2.01 | 0.002 | 0.002 | 0.25 | 0.010 | — | 0.05 | 0.033 | 0.0030 | 0.5530 | |
| D | 0.16 | 0.51 | 2.01 | 0.013 | 0.002 | 0.51 | 0.057 | 0.008 | — | 0.017 | 0.0046 | 0.5270 | |
| E | 0.15 | 0.53 | 2.04 | 0.001 | 0.002 | 0.25 | 0.010 | 0.008 | — | 0.033 | 0.0021 | 0.5630 | |
| F | 0.10 | 0.50 | 2.05 | 0.001 | 0.002 | 0.50 | — | 0.010 | — | 0.025 | 0.0041 | 0.5250 | |
| G | 0.16 | 0.51 | 2.01 | 0.013 | 0.002 | 0.51 | 0.057 | 0.008 | — | 0.017 | 0.0046 | 0.5270 | |
| H | 0.09 | 0.50 | 2.05 | 0.001 | 0.002 | 0.50 | — | 0.010 | — | 0.025 | 0.0041 | 0.5250 | Cu: 0.09, Mo: 0.21 |
| I | 0.12 | 0.84 | 2.01 | 0.002 | 0.003 | 0.25 | 0.010 | — | — | 0.174 | 0.0042 | 1.0140 | Ni: 0.10 |
| J | 0.12 | 0.52 | 2.01 | 0.002 | 0.002 | 0.25 | 0.010 | — | 0.05 | 0.036 | 0.0035 | 0.5560 | Mo: 0.20 |

A slab was prepared from 150 kg of each steel by vacuum melting followed by heating in a furnace at a temperature of 1250° C. and hot forging at a temperature of at least 900° C. Each slab was reheated at 1250° C. for at most one hour and subjected to rough rolling with four passes followed by finish rolling with three passes. The thickness of a sample steel sheet after hot rolling was 1.6-2.0 mm. The conditions for hot rolling and cooling are shown in Table 2.

In the manufacturing method for the steel sheet of Run No. 10, the time until cooling to 700° C. or below after the completion of rolling and the second cooling step did not satisfy the conditions according to the present invention.

In the manufacturing method for the steel sheet of Run No. 11, the time until cooling to 700° C. or below after the completion of rolling and the steps beginning with the first cooling step did not satisfy the conditions according to the present invention.

TABLE 2

| | | | Hot rolling conditions | | | | | | | Cooling conditions | | | | | | |
|---|---|---|---|---|---|---|---|---|---|---|---|---|---|---|---|---|
| | | | Rough rolling | | Finish rolling | | | | Time for cooling to 700° C. or below after completion of rolling | First cooling | | Intermediate air cooling | Second cooling | | | |
| Run No. | Steel type | Slab thickness (mm) | Number of passes | Overall reduction (%) | Number of passes | Reduction in each pass | Time between passes in finish rolling (s) | Finish rolling temp (° C.) | (s) | Average cooling rate (° C./s) | Cooling termination temp. (° C.) | time (= holding time) (a) | Cooling rate after intermediate air cooling (° C./s) | Cooling termination temp. (° C.) | Thickness of finished steel sheet (mm) | Remarks |
| 1 | A | 35 | 4 | 83 | 3 | 30%-30%-30% | 0.2 | 850 | 0.1 | >1000 | 650 | 0.5 | 70 | 300 | 2 | Invent. |
| 2 | A | 35 | 4 | 83 | 3 | 33%-33%-33% | 0.2 | 805 | 0.1 | >1000 | 630 | 0.5 | 80 | 350 | 1.6 | Invent. |
| 3 | A | 35 | 4 | 83 | 3 | 30%-30%-30% | 2.9 | 950 | 0.4 | 200 | 650 | 0.5 | 100 | 100 | 2 | Compar. |
| 4 | D | 35 | 4 | 80 | 3 | 20%-20%-23% | 0.5 | 890 | 0.7 | >1000 | 680 | 1 | 600 | 25 | 2 | Compar. |
| 5 | C | 35 | 4 | 83 | 3 | 30%-30%-30% | 0.2 | 850 | 0.1 | >1000 | 650 | 0.5 | 70 | 300 | 2 | Invent. |
| 6 | B | 35 | 4 | 83 | 3 | 30%-30%-30% | 0.2 | 850 | 0.1 | >1000 | 650 | 0.5 | 70 | 300 | 2 | Invent. |
| 7 | B | 35 | 4 | 83 | 3 | 30%-30%-30% | 0.2 | 850 | 0.1 | >1000 | 650 | 0.5 | 70 | 340 | 2 | Invent. |
| 8 | E | 35 | 4 | S3 | 3 | 33%-33%-33% | 0.2 | 820 | 0.1 | >1000 | 650 | 0.5 | 120 | 300 | 1.6 | Invent. |
| 9 | F | 35 | 4 | 83 | 3 | 33%-33%-33% | 0.2 | 820 | 0.1 | >1000 | 650 | 0.5 | 100 | 300 | 1.6 | Invent. |
| 10 | G | 35 | 4 | 80 | 3 | 20%-20%-23% | 0.5 | 890 | 0.7 | >1000 | 680 | 1 | 600 | 300 | 2 | Compar. |
| 11 | E | 35 | 4 | 83 | 3 | 30%-30%-30% | 0.3 | 850 | 1.0 | 200 | — | — | — | — | 2 | Compar. |
| 12 | H | 35 | 4 | 83 | 3 | 33%-33%-33% | 0.2 | 820 | 0.1 | >1000 | 650 | 0.5 | 100 | 300 | 1.6 | Invent. |
| 13 | I | 35 | 4 | 83 | 3 | 30%-30%-30% | 0.2 | 850 | 0.1 | >1000 | 650 | 0.5 | 70 | 300 | 2 | Invent. |
| 14 | J | 35 | 4 | 83 | 3 | 30%-30%-30% | 0.2 | 850 | 0.1 | >1000 | 650 | 0.5 | 70 | 300 | 2 | Invent. |

The steel sheets of Run Nos. 1, 2, 5-9, and 12-14 were manufactured by a manufacturing method according to the present invention. In the manufacturing method for the steel sheet of Run No. 3, the finish rolling step and the first and second cooling steps were not carried out under the conditions according to the present invention.

In the manufacturing method for the steel sheet of Run No. 4, the time until cooling to 700° C. or below after the completion of rolling and the second cooling step did not satisfy the conditions according to the present invention.

The results of evaluation of the metallurgical structure of the sample steel sheets obtained by the above-described manufacturing methods and the results of evaluation of the static tensile strength and the static-dynamic ratio are shown in Table 3. The methods of evaluation were as described below.

TABLE 3

| Run No. | Steel type | Ferrite phase: Area fraction (%) | Ferrite phase: Grain diameter (μm) Min. | Ferrite phase: Grain diameter (μm) Max. | Ferrite phase: Grain diameter (μm) Ave. | Ferrite phase: Nanohardness (GPa) Min. | Ferrite phase: Nanohardness (GPa) Max. | Ferrite phase: Nanohardness (GPa) Ave. | Second phase: Type | Second phase: Nanohardness (GPa) Min. | Second phase: Nanohardness (GPa) Max. | Second phase: Nanohardness (GPa) Ave. | Second phase: Area fraction of high-hardness phase (%) | Static tensile strength (MPa) | Strain rate region satisfying static-dynamic ratio index equation | Remarks |
|---|---|---|---|---|---|---|---|---|---|---|---|---|---|---|---|---|
| 1 | A | 12 | 0.6 | 2.5 | 1.2 | 3.7 | 4.4 | 4.1 | Martensite, Bainite | 5.3 | 11.8 | 7.8 | 11 | 980 | >10/s | Invent. |
| 2 | A | 27 | 0.5 | 1.3 | 0.8 | 3.9 | 4.4 | 4.0 | Martensite, Bainite | 7.4 | 12.4 | 10.8 | 35 | 925 | >30/s | Invent. |
| 3 | A | 50 | 4.6 | 7.8 | 5.3 | 3.4 | 3.6 | 3.5 | Martensite | 6.8 | 13.4 | 9.5 | 48 | 1027 | None | Compar. |
| 4 | D | 35 | 3.8 | 8.7 | 4.2 | 2.8 | 4.1 | 3.4 | Martensite | 8.8 | 12.5 | 9.7 | 55 | 1115 | None | Compar. |
| 5 | C | 8 | 0.7 | 2.2 | 1.1 | 3.8 | 4.3 | 4.1 | Martensite, Bainite | 6.1 | 11.0 | 8.5 | 15 | 1050 | >10/s | Invent. |
| 6 | B | 10 | 0.9 | 2.5 | 1.3 | 3.9 | 4.3 | 4.0 | Martensite, Bainite | 6.7 | 11.8 | 7.9 | 18 | 1005 | >30/s | Invent. |
| 7 | B | 18 | 1.3 | 2.8 | 1.6 | 3.7 | 4.2 | 4.0 | Martensite, Bainite | 7.2 | 10.9 | 8.3 | 7 | 975 | >30/s | Invent. |
| 8 | E | 15 | 0.5 | 1.5 | 0.8 | 3.6 | 4.4 | 4.1 | Martensite, Bainite | 6.2 | 11.0 | 8.2 | 26 | 999 | >30/s | Invent. |
| 9 | F | 32 | 0.7 | 2.4 | 1.1 | 3.7 | 4 | 3.9 | Martensite, Bainitic ferrite | 5.9 | 10.8 | 7.9 | 18 | 876 | >10/s | Invent. |
| 10 | G | 42 | 3.0 | 7.5 | 5.4 | 4.0 | 4.5 | 4.2 | Martensite | 7.2 | 13.5 | 9.8 | 45 | 1050 | None | Compar. |
| 11 | E | 13 | 4.2 | 10.8 | 6.3 | 3.1 | 4.1 | 3.8 | Martensite | 6.8 | 13.5 | 10.5 | 87 | 1099 | None | Compar. |
| 12 | H | 32 | 0.7 | 2.4 | 1.1 | 3.7 | 4 | 3.9 | Martensite, Bainitic ferrite | 5.9 | 10.8 | 7.9 | 18 | 905 | >10/s | Invent. |
| 13 | I | 16 | 0.6 | 1.6 | 0.9 | 3.6 | 4.3 | 4.1 | Martensite, Bainite | 6.2 | 10.8 | 8.1 | 28 | 1075 | >10/s | Invent. |
| 14 | J | 9 | 0.8 | 2.2 | 1.2 | 3.8 | 4.3 | 4 | Martensite, Bainite | 6.1 | 10.9 | 8.4 | 16 | 1050 | >10/s | Invent. |

In Tables 1 to 3, the underlined values and the underlined structure of the second phase mean that they are outside the range of the present invention.

Evaluation of the fraction and nanohardness of each phase was carried out by performing the below-described measurement on a ¼ sheet thickness portion in a cross section cut parallel to the rolling direction of the sample steel sheet.

The nanohardness of ferrite and the hard phase was found by the nanoindentation method. The nanoindentation apparatus which was used was a Triboscope manufactured by Hysitron Corporation. A cross section of a ¼ sheet thickness portion of a sample steel sheet was polished with emery paper, then by mechanochemical polishing using colloidal silica, and then by electrolytic polishing to obtain a cross section from which the affected layer has been removed. This cross section was subjected to a test. Nanoindentation was carried out at room temperature and atmospheric pressure using a Berkovich indenter having a tip angle of 90°. The indentation load was 500 μN. For each phase, randomly selected 20 points were measured, and the minimum nanohardness, the maximum nanohardness, and the average value for these points were determined.

The area fraction and the grain diameter of ferrite were determined from a two-dimensional image obtained by observing a ¼ sheet thickness portion of the cross section at a magnification of 3000× using a scanning electron microscope. Specifically, ferrite grains were identified on the resulting image, the areas of the ferrite grains were measured, and the total area of the ferrite grains was divided by the area of the entire image to give the area fraction of ferrite. In addition, image analysis of each ferrite grain was individually carried out to determine its equivalent circle diameter, and the average value thereof was taken as the ferrite grain diameter.

The area fraction of a high-hardness phase having a nanohardness of 8-12 GPa was determined in the following manner.

An arbitrarily selected 10 μm×10 μm area was observed with an atomic force microscope incorporated in the nanoindentation apparatus to obtain a two-dimensional image. Based on the difference in the contrast of crystals visible in the resulting two-dimensional image, it is possible to determine whether crystals in the image are ferrite or a second phase, so based on the resulting image, crystal grains which were a second phase were identified. The nanoindentation hardness was measured for all of the crystal grains which were identified as a second phase. Among the measured crystal grains, those having a nanohardness of 8-12 GPa were determined to be a high-hardness phase. The area fraction of the high-hardness phase was determined from the total area of crystal grains which were identified as a high-hardness phase.

The static tensile strength and the dynamic strength were measured using a load sensing block-type material testing system. The sample piece had a gage width of 2 mm and a gage length of 4.8 mm. The static tensile strength was determined from the tensile strength at a strain rate of 0.001 $s^{-1}$, namely, the quasi-static strength. A tensile test was also carried out while varying the strain rate in the range of 0.001 $s^{-1}$-1000 $s^{-1}$, and the dynamic strength was evaluated by determining the dependency of the static-dynamic ratio index on the strain rate. The standard for evaluation was as follows. When above-described Equation (1) was satisfied at a strain rate of 30 $s^{-1}$ or higher, the dynamic strength properties were evaluated as excellent, and when above-described Equation (1) was satisfied at a strain rate of 10 $s^{-1}$ or higher, the dynamic strength properties were evaluated as particularly excellent.

FIG. 1 shows the relationship between the static-dynamic ratio index and the strain rate obtained using each sample steel sheet.

The steel sheets of Run Nos. 3, 4, 10, and 11 did not satisfy Equation (1) at a strain rate of 30 $s^{-1}$ or higher. Accordingly, it was concluded that these steel sheets did not have excellent dynamic strength properties.

In contrast, for the steel sheets of Run Nos. 1, 2, 5-9, and 12-14, although the static-dynamic ratio index did not satisfy Equation (1) when the strain rate was extremely low, there was an inflection point in a strain rate region of 10-30 $s^{-1}$, and the static-dynamic ratio index abruptly increased. Each of these steel sheets satisfied Equation (1) when the strain rate was 30 $s^{-1}$ or higher, so it was concluded that these steel sheets had excellent dynamic strength properties. Such steel sheets can be suitably used as impact members for automobiles. In particular, the steel sheets of Run Nos. 1, 5, and 9 satisfied Equation (1) even at a lower strain rate of 1 10 $s^{-1}$ or higher, so it was concluded that these steel sheets had particularly excellent dynamic strength properties. Such steel sheets are particularly suitable as impact members for automobiles.

The invention claimed is:

1. A multi-phase hot-rolled steel sheet characterized by:

having a chemical composition comprising, in mass percent,

C: at least 0.07% and at most 0.2%,

Si+Al: at least 0.3% and at most 1.5%,

Mn: at least 1.0% and at most 3.0%,

P: at most 0.02%,

S: at most 0.005%,

Cr: at least 0.1% and at most 0.5%,

N: at least 0.001% and at most 0.008%, one or two of Ti: at least 0.002% and at most 0.05%, the Ti of at least 0.002% and at most 0.05% existing as Ti nitride and carbide, and Nb: at least 0.002% and at most 0.05%, the Nb of at least 0.002% and at most 0.05% existing as Nb nitride and carbide, and a remainder of Fe and impurities, having ferrite with an area fraction at least 7% and at most 35%, the ferrite having a grain diameter of at least 0.5 μm and at most 3.0 μm and a nanohardness of at least 3.5 GPa and at most 4.5 GPa, and having a second phase which is the remainder other than ferrite, the second phase including martensite and at least one selected from bainitic ferrite and bainite and having an average nanohardness of at least 5 GPa and at most 12 GPa, the second phase containing a high-hardness phase of at least 8 GPa and at most 12 GPa with an area fraction of at least 5% and at most 35% with respect to the overall structure.

2. A multi-phase hot-rolled steel sheet as set forth in claim 1 characterized in that the chemical composition further contains, in mass percent, a most 0.2% of V.

3. A multi-phase hot-rolled steel sheet as set forth in claim 1 characterized in that the chemical composition further contains one or more elements selected from the group consisting of, in mass percent, Cu: at most 0.2%, Ni: at most 0.2%, and Mo: at most 0.5%.

4. A method of manufacturing the multi-phase hot-rolled steel sheet as set forth in claim 1 by continuous hot rolling of a slab having a chemical composition comprising, in mass percent, C: at least 0.07% and at most 0.2%, Si+Al: at least 0.3% and at most 1.5%, Mn: at least 1.0% and at most 3.0%, P: at most 0.02%, S: at most 0.005%, Cr: at least 0.1% and at most 0.5%, N: at least 0.001% and at most 0.008%, one or two of Ti: at least 0.002% and at most 0.05% and Nb: at least 0.002% and at most 0.05%, and a remainder of Fe and impurities to manufacture a hot-rolled steel sheet, the multi-phase hot-rolled steel sheet having ferrite with an area fraction at least 7% and at most 35%, the ferrite having a grain diameter of at least 0.5 μm and at most 3.0 μm and a nanohardness of at least 3.5 GPa and at most 4.5 GPa, and having a second phase which is the remainder other than ferrite, the second phase including martensite and at least one selected from bainitic ferrite and bainite and having an average nanohardness of at least 5 GPa and at most 12 GPa, the second phase containing a high-hardness phase of at least 8 GPa and at most 12 GPa with an area fraction of at least 5% and at most 35% with respect to the overall structure, the method comprising the following steps:

a finish rolling step in which the slab is rolled in final finish rolling at a temperature of at least 800° C. and at most 900° C. with the length of time between passes being at least 0.15 seconds and at most 2.7 seconds to form a steel sheet;

a first cooling step including cooling the steel sheet obtained by the finish rolling step to a temperature of 700° C. or below within 0.4 seconds at a cooling rate of at least 600° C./sec;

a holding step including holding the steel sheet which passed through the cooling step in a temperature range of at least 570° C. to at most 700° C. for at least 0.4 seconds; and a second cooling step including cooling the steel sheet which passed through the holding step to 430° C. or below at a cooling rate of at least 20° C./sec and at most 120° C./sec.

5. A method of manufacturing a multi-phase hot-rolled steel sheet as set forth in claim 4 characterized in that the chemical composition further contains, in mass percent, at least 0.2% of V.

6. A method of manufacturing a multi-phase hot-rolled steel sheet as set forth in claim 4 characterized in that the chemical composition further contains one or more elements selected from the group consisting of, in mass percent, Cu: at most 0.2%, Ni: at most 0.2%, and Mo: at most 0.5%.

* * * * *